US008579470B1

(12) United States Patent
Leahy et al.

(10) Patent No.: US 8,579,470 B1
(45) Date of Patent: Nov. 12, 2013

(54) LED ILLUMINATION SOURCE WITH IMPROVED VISUAL CHARACTERISTICS

(71) Applicants: James Leahy, Old Greenwich, CT (US); Chris Hartswick, New York, NY (US); Stephen Johnson, Newburyport, MA (US)

(72) Inventors: James Leahy, Old Greenwich, CT (US); Chris Hartswick, New York, NY (US); Stephen Johnson, Newburyport, MA (US)

(73) Assignee: Solais Lighting, Inc., Stamford, CT (US)

( * ) Notice: Subject to any disclaimer, the term of this patent is extended or adjusted under 35 U.S.C. 154(b) by 0 days.

(21) Appl. No.: 13/686,403

(22) Filed: Nov. 27, 2012

Related U.S. Application Data

(63) Continuation of application No. PCT/US2012/000467, filed on Oct. 3, 2012.

(60) Provisional application No. 61/636,619, filed on Apr. 20, 2012, provisional application No. 61/595,665, filed on Feb. 6, 2012, provisional application No. 61/620,972, filed on Apr. 5, 2012, provisional application No. 61/542,748, filed on Oct. 3, 2011.

(51) Int. Cl.
*F21V 33/00* (2006.01)

(52) U.S. Cl.
USPC ..... 362/249.02; 362/254; 362/311.02

(58) Field of Classification Search
USPC ..... 362/254, 249.02, 311.02
See application file for complete search history.

(56) References Cited

U.S. PATENT DOCUMENTS

| | | | |
|---|---|---|---|
| 2,233,780 | A | 3/1941 | Gould |
| 2,572,825 | A | 10/1951 | Guth |
| 3,462,591 | A | 8/1969 | Pichard |
| 4,516,196 | A | 5/1985 | Blake |
| 4,882,662 | A | 11/1989 | Prodell |

(Continued)

FOREIGN PATENT DOCUMENTS

| | | |
|---|---|---|
| CN | 201237097 | 5/2009 |
| CN | 201368349 | 12/2009 |

(Continued)

OTHER PUBLICATIONS

"CCTV IR Camera" 1st-Product.com. http://1st-product.com/products/228/CCTV-IR-Camera-134006.html (accessed May 3, 2012).

(Continued)

*Primary Examiner* — Laura Tso
(74) *Attorney, Agent, or Firm* — Kristofer E. Elbing

(57) ABSTRACT

An illumination source is disclosed that features, in one embodiment, an at least generally conical body extending outward along an axis of illumination, a socket supported with respect to the body having a pair of connector surfaces for receiving power and having an axis of insertion at least generally parallel to the axis of illumination, and one or more LED illumination elements supported with respect to the body such that at least a portion of their illumination axes are at least generally parallel to the axis of illumination of the source. A power supply has electrical inputs operatively connected to the socket and electrical outputs operatively connected to the LED illumination elements, and a front face is positioned opposite the socket along the illumination axis. An optical light-directing element is provided separate from any optical process or packaging surfaces built onto the LEDs, is disposed between the LED illumination elements and the front face, and has medial and distal ends, with the distal end being spaced away from the front face.

29 Claims, 20 Drawing Sheets

(56) References Cited

U.S. PATENT DOCUMENTS

| | | | | |
|---|---|---|---|---|
| 5,486,989 | A | 1/1996 | Compton | |
| 5,562,343 | A | 10/1996 | Chan et al. | |
| 5,607,230 | A | 3/1997 | Protz | |
| 5,803,571 | A | 9/1998 | McEntyre et al. | |
| 5,860,728 | A | 1/1999 | Maglica | |
| 6,149,283 | A | 11/2000 | Conway et al. | |
| 6,206,544 | B1 | 3/2001 | Costa | |
| 6,234,645 | B1 | 5/2001 | Borner et al. | |
| 6,234,648 | B1 | 5/2001 | Borner et al. | |
| 6,250,774 | B1 | 6/2001 | Begemann et al. | |
| 6,441,943 | B1 | 8/2002 | Roberts et al. | |
| 6,527,422 | B1 | 3/2003 | Hutchison | |
| 6,554,453 | B2 | 4/2003 | Rao | |
| 6,837,596 | B2 | 1/2005 | Tanaka et al. | |
| 6,929,226 | B1 | 8/2005 | Philistine | |
| 6,932,491 | B2 | 8/2005 | Esakoff | |
| 6,942,368 | B1 | 9/2005 | Kane et al. | |
| 7,059,752 | B2 | 6/2006 | Yagi et al. | |
| 7,144,135 | B2 | 12/2006 | Martin et al. | |
| 7,144,140 | B2 | 12/2006 | Sun et al. | |
| 7,213,940 | B1 | 5/2007 | Van De Ven et al. | |
| 7,234,842 | B2 | 6/2007 | Frederico | |
| 7,314,289 | B2 | 1/2008 | Montagne | |
| 7,344,279 | B2 | 3/2008 | Mueller et al. | |
| 7,350,936 | B2 | 4/2008 | Ducharme et al. | |
| 7,510,306 | B1 | 3/2009 | Aubrey | |
| 7,520,636 | B2 | 4/2009 | Van Der Poel | |
| 7,597,456 | B2 | 10/2009 | Catalano et al. | |
| 7,633,779 | B2 | 12/2009 | Garrity et al. | |
| 7,658,510 | B2 | 2/2010 | Russell | |
| 7,661,854 | B1 | 2/2010 | Yang et al. | |
| 7,810,941 | B2 | 10/2010 | Capozzi | |
| 7,828,465 | B2 | 11/2010 | Roberge et al. | |
| 7,905,626 | B2 | 3/2011 | Shantha et al. | |
| 7,972,040 | B2 | 7/2011 | Li et al. | |
| 8,118,455 | B2 | 2/2012 | Cowan et al. | |
| 2001/0007527 | A1 | 7/2001 | Lammers | |
| 2003/0185005 | A1 | 10/2003 | Sommers | |
| 2005/0168986 | A1 | 8/2005 | Wegner | |
| 2005/0169015 | A1 | 8/2005 | Luk | |
| 2009/0116251 | A1 | 5/2009 | Harbers et al. | |
| 2009/0129101 | A1 | 5/2009 | Bowden | |
| 2009/0207612 | A1 | 8/2009 | Datz et al. | |
| 2010/0128483 | A1 | 5/2010 | Reo et al. | |
| 2010/0177515 | A1 | 7/2010 | Shoushtari | |
| 2011/0095690 | A1 | 4/2011 | Sagal | |
| 2011/0096548 | A1* | 4/2011 | Pickard | 362/294 |
| 2011/0157900 | A1 | 6/2011 | Garner | |
| 2011/0170294 | A1 | 7/2011 | Mier-Langner et al. | |
| 2011/0181200 | A1 | 7/2011 | Luk et al. | |
| 2011/0279063 | A1 | 11/2011 | Wang et al. | |
| 2011/0286219 | A1 | 11/2011 | Guercio et al. | |
| 2011/0305018 | A1 | 12/2011 | Angelini et al. | |
| 2012/0014107 | A1 | 1/2012 | Avila | |
| 2012/0113638 | A1* | 5/2012 | Uemoto et al. | 362/235 |
| 2012/0224363 | A1* | 9/2012 | Van De Ven | 362/231 |
| 2012/0243235 | A1* | 9/2012 | Gao | 362/294 |
| 2012/0275165 | A1* | 11/2012 | Choi et al. | 362/294 |

FOREIGN PATENT DOCUMENTS

| | | |
|---|---|---|
| CN | 201391827 | 1/2010 |
| CN | 202024226 | 11/2011 |
| EP | 2100076 | 6/2008 |
| JP | 3064806 | 3/1991 |
| SU | 1163795 | 7/1983 |
| WO | WO 2011/085146 | 7/2011 |
| WO | WO 2011/152038 | 8/2011 |

OTHER PUBLICATIONS

"Ghost—Black Par 64 Scheinwerfer" Woodbrass.com. http://www.woodbrass.com/en/product_info.php?products_id=60584&af=35 (accessed May 3, 2012).

"HydroStar" O'Ryan Industries. http://oryanindustries.com/products/pool-and-spa/hydrostar/ (accessed May 3, 2012).

"Julietliter GU-4503" Nightscaping.com. http://www.nightscaping.com/Julietliter.php (accessed May 3, 2012).

"LED PAR 64/168-10" http://www.articulight.com/led/led_par64-168/index.html (accessed Feb. 10, 2012).

"LED Trackhead Luminaire requires 20/50 W of power to operate" http://news.thomasnet.com/fullstory/LED-Trackhead-Luminaire-requires-20-50-W-of-power-to-operate-826928 (accessed Feb. 10, 2012).

"Profoto Snoot for Grid & Filterholder" http://teamworkphoto.com/shop/index.php?main_page=product_info&cPath=1016&products_id=15108 (accessed Feb. 10, 2012).

"Swing Arm Clamp Magnifying Lamp" Alibaba. http://www.alibaba.com/product-gs/465872323/Swing_Arm_Clamp_Magnifying_Lamp.html (accessed May 3, 2012).

"Unitron LED Ring Light with Simple Polarizer/Analyzer" Microscope. International.http://microscopeinternational.com/unitron-led-ring-light-with-simple-polarizer-analyzer (accessed May 3, 2012).

"52 in 52—Design(s) Sixteen Complete" Lumeniquessl.Com. http://lumeniquessl.com/2010/05/07/52-in-52-designs-sixteen-complete/ (accessed Feb. 10, 2012).

* cited by examiner

LED ILLUMINATION SOURCE WITH IMPROVED VISUAL CHARACTERISTICS

CROSS-REFERENCE TO RELATED APPLICATIONS

This application a continuation of international application no. PCT/US12/00467, filed Oct. 3, 2012. This application also claims priority to U.S. provisional application Ser. Nos. 61/542,748, 61/595,665, 61/620,972, and 61/636,619. All five of these applications are entitled LED ILLUMINATION SOURCE WITH IMPROVED VISUAL CHARACTERISTICS and herein incorporated by reference.

FIELD OF THE INVENTION

This invention relates to illumination methods and apparatus based on Light Emitting Diodes (LEDs).

BACKGROUND OF THE INVENTION

There is considerable attention being given to the use of high brightness LED (HBLED) technology as a light source to replace traditional incandescent lamps. The catalyst for introduction of white LEDs, first as indicators, and later for viable commercial illumination sources, has primarily been due to development and refinement of blue-LED material-science processes, in conjunction with appropriate yellow-phosphor coatings for what is termed secondary emission. The science of secondary emission has been long understood by those skilled in lighting technology and such science has previously provided the basis for fluorescent and most other gaseous discharge lamps.

In such a process of secondary emission, monochromatic light, generated within a phosphor-coated LED chip, causes the phosphor to emit light of different wavelengths. This has resulted in white HBLEDs, with rating of up to a few watts and lumen outputs, depending on color temperature, exceeding 100 lumens per watt.

The mechanism is much like that in a gaseous discharge tube lamp where ultraviolet light excites the phosphor coating on the inside of an evacuated glass tube to create visible white light. Interestingly, many of the difficulties in refining the technology of white LEDs relate to the same issues experienced with gaseous discharge lamps in mastering phosphor composition and deposition processes to achieve consistency and desired performance.

The fundamentals of incandescent lamp design have changed little in the last 75 years. Similarly, the design and performance of fluorescent lamps have not changed substantially in the last 40 years. That is to say, both incandescent and fluorescent lamp processes are considered to be mature technologies, with very little gain in efficacy (i.e., lumens per watt) expected in the near future.

High brightness LED's, on the other hand, are experiencing some gain in efficacy each year as scientists refine techniques for light extraction from the chip and slowly master the composition and deposition of phosphors. When many of these factors are better understood in the future and efficacy is further improved (a projection accepted by most industry experts) the LED lamps will be far more easily accepted and many of the present challenges will be mitigated. Until that happens, however, there are compelling reasons to develop novel techniques to enhance what now exists so as to accelerate commercial viability.

Two factors are driving the substantial interest in white-emitting HBLEDs as a candidate to replace incandescent lamps in a large number of general illumination applications: longevity and energy conservation.

The typical white HBLED chip, generally rated from 0.25 to three watts, if used properly, is expected to have a useful operating life of over 50,000 hours, dramatically longer than the 750-2,000 hours of a typical incandescent lamp and much longer than the typical 6,000 hours of a compact fluorescent lamp. Readily available HBLEDs can exhibit efficacies of more than 100 lumens per watt, 6-10 times better than either a regular or quartz-halogen version of an incandescent lamp.

While there is significant saving in bulb replacement expense over a number of years, it is the saving in electricity costs which presents the most significant benefit. In conditions of near-continual operation, such as in restaurants, hotels, stores, museums, or other commercial installations, the electricity savings can provide a very favorable return on investment, even with relatively high purchase prices, in 18-24 months. The potential for rapid payback is generally much more evident than for other highly publicized "green" technologies" such as hybrid vehicles, wind turbines, solar power etc.

There is widespread acceptance that white-light LED sources are attractive as possible incandescent replacement lamps, especially in those types where the LED lamp is at its best, namely as reflector-type lamps such as PAR 30, PAR 38, or MR16. LEDs are by their nature directional light sources in that their light is emitted typically in a conical 120-150 degree beam angle, whereas an incandescent lamp tends to radiate in a near 360-degree spherical pattern and needs loss-inducing reflectors to direct light. Compact fluorescent lamps, because they are very difficult to collimate, are very inefficient when used as directional light sources.

The LED lamp starts out in a better position in spot or flood lamp applications because of its inherent directionality. In fixtures for ceiling downlighting, outside security, or retail merchandise highlighting, the need is for directional lighting, a factor taking advantage of the LED lamp's inherent emission characteristics. Those with a reasonable knowledge of physics know that a point source of light is best for use with a reflector or collimator. A CFL, being the virtual opposite of a point source, is poor in this respect. An incandescent filament is much smaller but still needs a good-sized reflector. An LED chip, being typically no larger than a millimeter on a side, lends itself to many more options with much smaller reflectors and collimating lenses.

Consequently, while white HBLEDs may alone, or as a partner with the compact fluorescent lamp (CFL), replace incandescent filament lamps, it is in the reflector lamps where the performance and economics of white LEDs appear likely to have the more immediate impact. While the CFL has become widely commercialized, the LED lamp does have certain advantages, which over the long term could give it a substantial marketing edge. Specifically, compared to a CFL, the LED lamp is a) more compatible with standard lamp dimming methodologies b) can more easily operate in low temperature, c) has no mercury content d) retains its efficacy when dimmed e) is essentially immune to shock and vibration and f) is immune to the degradation which CFL's experience with repetitive on/off cycling.

Referring to FIG. 4, prior art LED sources generally emit light out of an opening opposite their bases, which can be equipped with a faceplate. When mounted vertically in a ceiling fixture, this arrangement allows light to shine from the LEDs in all directions below the source (180 degrees). This illumination pattern is similar to that of existing incandescent flood and spot lamps and has therefore been considered a desirable arrangement in LED sources that are intended to replace these types of lamps.

SUMMARY OF THE INVENTION

In one general aspect, the invention features an illumination source that includes an at least generally conical body extending outward along an axis of illumination, a socket supported with respect to the body having a pair of connector surfaces for receiving power and having an axis of insertion at least generally parallel to the axis of illumination, and one or more LED illumination elements supported with respect to the body such that at least a portion of their illumination axes are at least generally parallel to the axis of illumination of the source. A power supply has electrical inputs operatively connected to the socket and electrical outputs operatively connected to the LED illumination elements, and a front face is positioned opposite the socket along the illumination axis. An optical light-directing element is provided separate from any optical process or packaging surfaces built onto the LEDs, is disposed between the LED illumination elements and the front face, and has medial and distal ends, with the distal end being spaced away from the front face.

In preferred embodiments the optical light-directing element can include a collimating element. The optical light-directing element can include a lens element. The lens element can include a TIR or Fresnel element. The optical light-directing element can include a reflective surface. The reflective surface can be shaped as a circular truncated section of a right cone. The optical light-directing element can include a snoot. The optical light-directing element can include a TIR. The optical light directing element can include at least one opaque surface mounted on the source that is positioned to block light between at least one of the LED illumination elements and positions outside of the circumference of the front face aperture and opposite the base with respect to the front face aperture. The front face can be clear with the optical light-directing element being placed at a sufficient distance from the front face to significantly reduce an angle of view of the LED illumination elements, which is different from the beam angle, while allowing light to form a spot beam through the front face. The front face can be dimpled or frosted with the optical light-directing element being placed at a sufficient distance from the front face to significantly reduce an angle of view of the LED illumination elements while allowing light to form a flood beam through the front face. The optical light-directing element can be placed at a sufficient distance from the front face to significantly reduce an angle of view of the LED illumination elements while allowing light to reach substantially all of the front face. The angle of view of the LED illumination elements can be 65 degrees or less about the axis of illumination. The angle of view of the LED illumination elements can be 55 degrees or less about the axis of illumination. The angle of view of the LED illumination elements can be 45 degrees or less about the axis of illumination. The optical light-directing element can be separated from the front face by at least 0.5 inches. The optical light-directing element can be separated from the front face by at least 1 inch. The optical light-directing element can be separated from the front face by at least 1.5 inches. The optical light-directing element can be mounted on the body of the source. The source can include a plurality of LEDs. The illumination source can be a PAR-type replacement lamp. The illumination source can be a BR-type replacement lamp.

In another general aspect, the invention features an illumination method that includes receiving power at a socket, converting the received power and sending it to one or more LED elements, redirecting light from the LED powered elements, shining the redirected light through an optically neutral area, and shining the redirected light through a front face after it has shined through the optically neutral area.

In preferred embodiments the step of redirecting can shield the LED elements from view from at least a subset of an area illuminated through the front face. The step of redirecting can be performed by a lens element. The step of redirecting can be performed by a reflective surface. The step of redirecting can be performed by a snoot.

In a further general aspect, the invention features an illumination source that includes means for receiving power, means converting received power and sending it to one or more LED elements, means for redirecting light from the LED powered elements, optically neutral means for passing the redirected light, and front face means for passing the redirected light after it has passed through the optically neutral area.

In another general aspect, the invention features an illumination source that includes a base having a pair of connector surfaces for receiving power, a body connected to the base, one or more LED illumination elements supported inside the body and facing away from the base, circuitry for driving the LED illumination elements supported inside the body, a front face aperture positioned opposite the LED illumination elements with respect to the base, and a field-operable mounting mechanism for mounting removable light-modifying accessories located at the front face aperture.

In preferred embodiments, the mounting mechanism can include a partially removable holder for a light-modifying accessory. The mounting mechanism can include a fully removable holder for a light-modifying accessory. The mounting mechanism can include a holder for a light-modifying accessory and wherein the holder includes an integral snoot. The mounting mechanism can include a holder for disk-shaped light-modifying accessories. The mounting mechanism can be constructed to engage a corresponding mounting mechanism on a fully removable light-modifying accessory. The mounting mechanism can be a twist-and-lock mounting mechanism. The twist-and-lock mounting mechanism can include three prongs. The mounting mechanism can be a tool-free mechanism. The mounting mechanism can require only a screwdriver or Allen wrench. The source can further include a light-modifying accessory. The light-modifying accessory can be a snoot. The light-modifying accessory can be a baffle. The light-modifying accessory can be a honeycomb louver. The light-modifying accessory can be a light-modifying filter. The light-modifying accessory can be a color filter. The light-modifying accessory can be a diffuser. The light-modifying accessory can include at least one lens. The light-modifying accessory can include at least one frosted surface. The light-modifying accessory can include a spread lens. The light-modifying accessory can include a gobo. The illumination source can be part of a kit that further includes a plurality of different light-modifying accessories each being constructed to interact with the mounting mechanism.

Systems according to the invention can de-emphasize the appearance of the LEDs in an LED-based illumination source and instead provide a more even overall appearance from a variety of different angles.

DETAILED DESCRIPTION OF AN ILLUSTRATIVE EMBODIMENT

Figure 1:
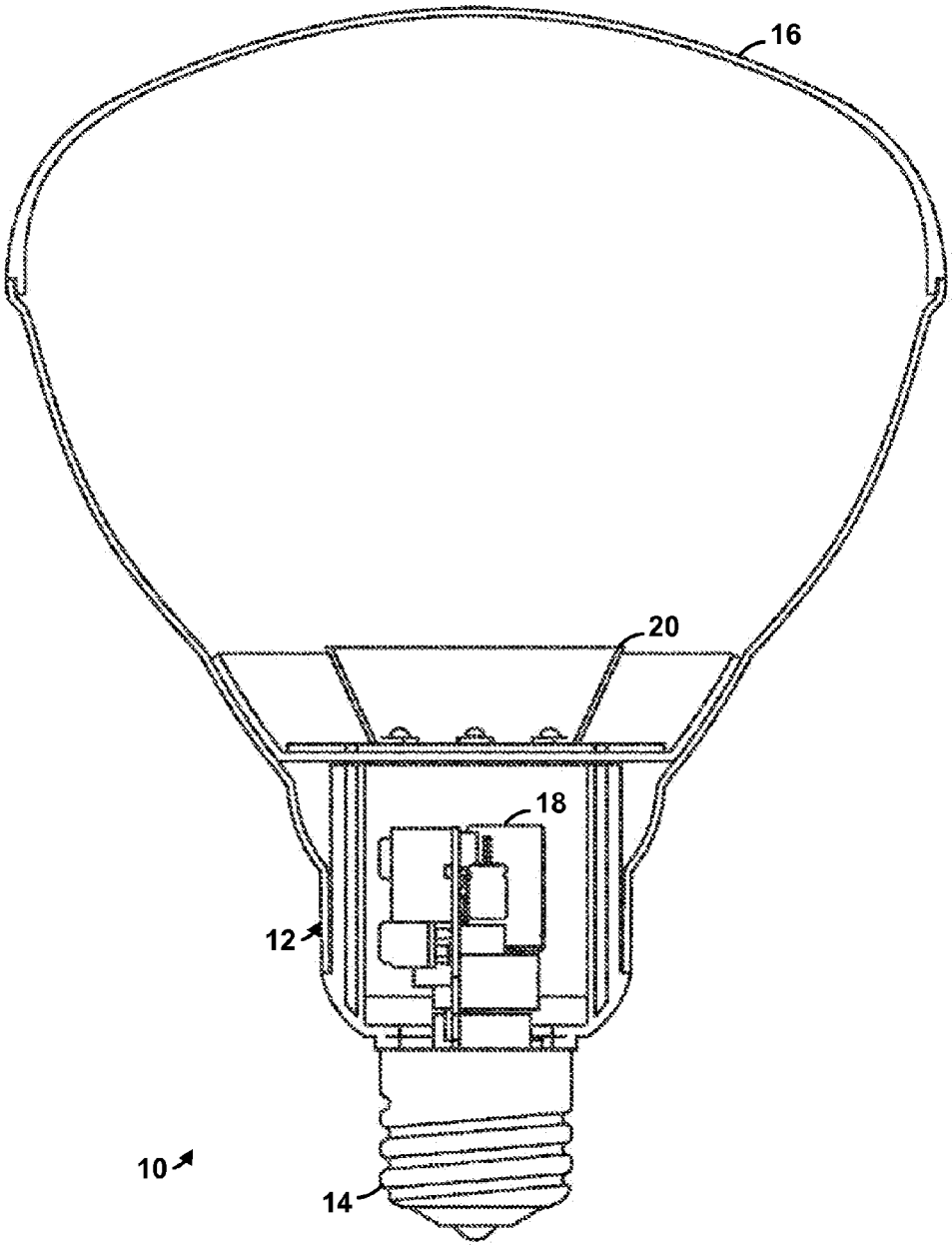
FIG. 1 is a cross-sectional diagram illustrating a first illustrative LED source according to the invention employing a reflective surface.

FIG. 1 is a block diagram of an illustrative LED source 10 according to the invention. This source also includes a generally conical body 12 with a base 14, such as a standard light bulb screw base and a front face 16 that can take a variety of forms, such as a glass cover, a frosted diffuser, or a dimpled lens. The body holds a power supply 18 that receives power from the base and powers one or more LEDs. The LEDS are positioned at the base of a generally conical section of the body that includes a reflector optic 20 that can be shaped in a variety of shapes, such as a parabola or conical section, to surround the LEDs over a portion of the conical body. The reflector optic can also have walls that conform to the LEDs or other features of the source.

The height and diameter of the reflector are selected to allow light to shine out of the whole front face as well as to shield the LEDs from view from at least some angles (e.g., preferably outside about 45, 55, or even 65 degrees from the axis of illumination). In one embodiment of a PAR-30 lamp, for example, the reflector can end around half an inch below the front face, but it can also end one inch below the front face, or even one-and-a half inches or more below the front face.

In one embodiment construction includes an aluminum shell as used in compact fluorescent bulbs, with added aluminum to conduct heat from the LEDS. The base is plastic inside the aluminum shell.

Figure 2:
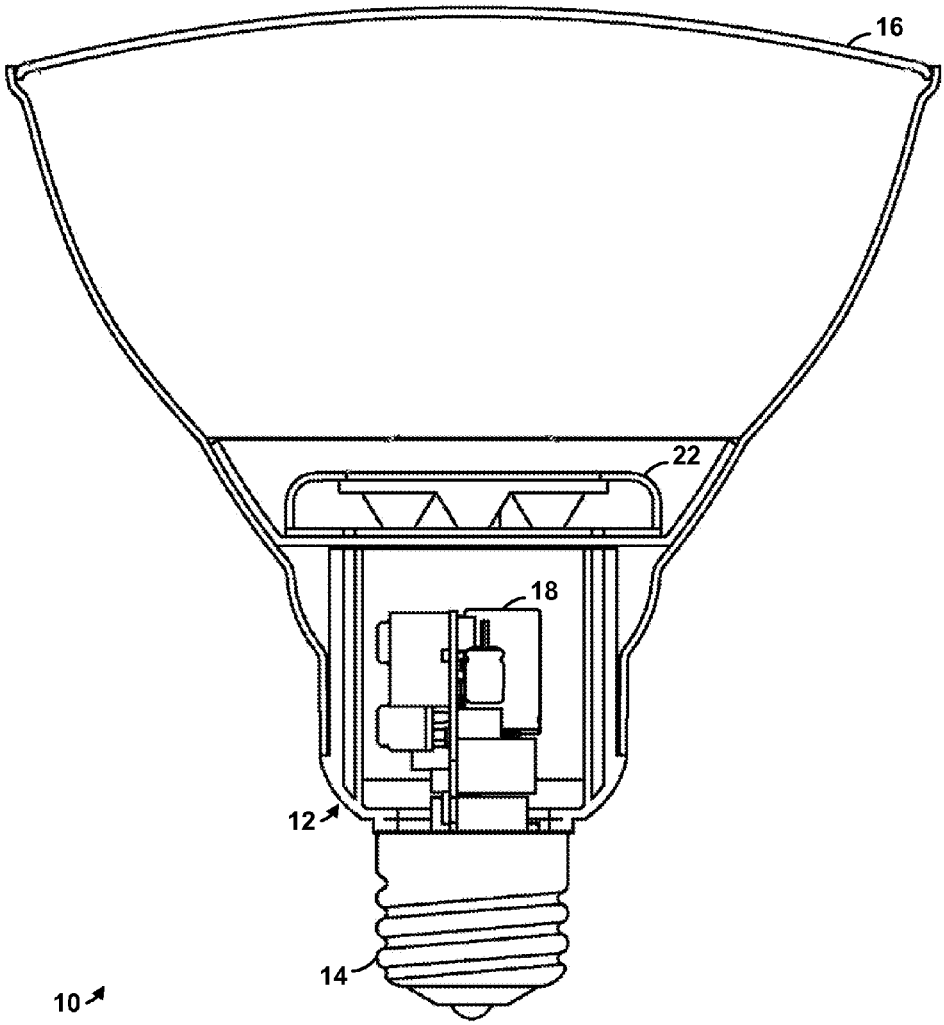
FIG. 2 is a cross-sectional diagram illustrating a second illustrative LED source according to the invention employing a recessed lens element.

FIG. 2 is a block diagram of a second illustrative LED source 10 according to the invention. This source also includes a generally conical body 12 with a base 14, such as a standard light bulb screw base and a front face 16 that can take a variety of forms, such as a glass cover, a frosted diffuser, or a dimpled lens. The body holds a power supply 18 that receives power from the base and powers one or more LEDs. A lens element 22 is positioned at a recessed location between the LEDS and the front face. The lens element is transparent and can be one of a variety of different types of lenses, such as a Total Internal Reflection (TIR) lens, and is a separate element from any optical process or packaging surfaces built onto the LEDs.

As with the reflector, the height and characteristics of the lens element are selected to allow light to shine out of the whole front face as well as to shield the LEDs from view from at least some angles (e.g., preferably outside about 45, 55, or even 65 degrees from the axis of illumination). In one embodiment of a PAR-30 lamp, for example, the lens element can end around half an inch below the front face, but it can also end one inch below the front face, or even one-and-a half inches or more below the front face. In one embodiment, the TIR is a 10-degree TIR optic and the power supply is enclosed in silver colored plastic.

Figure 3:
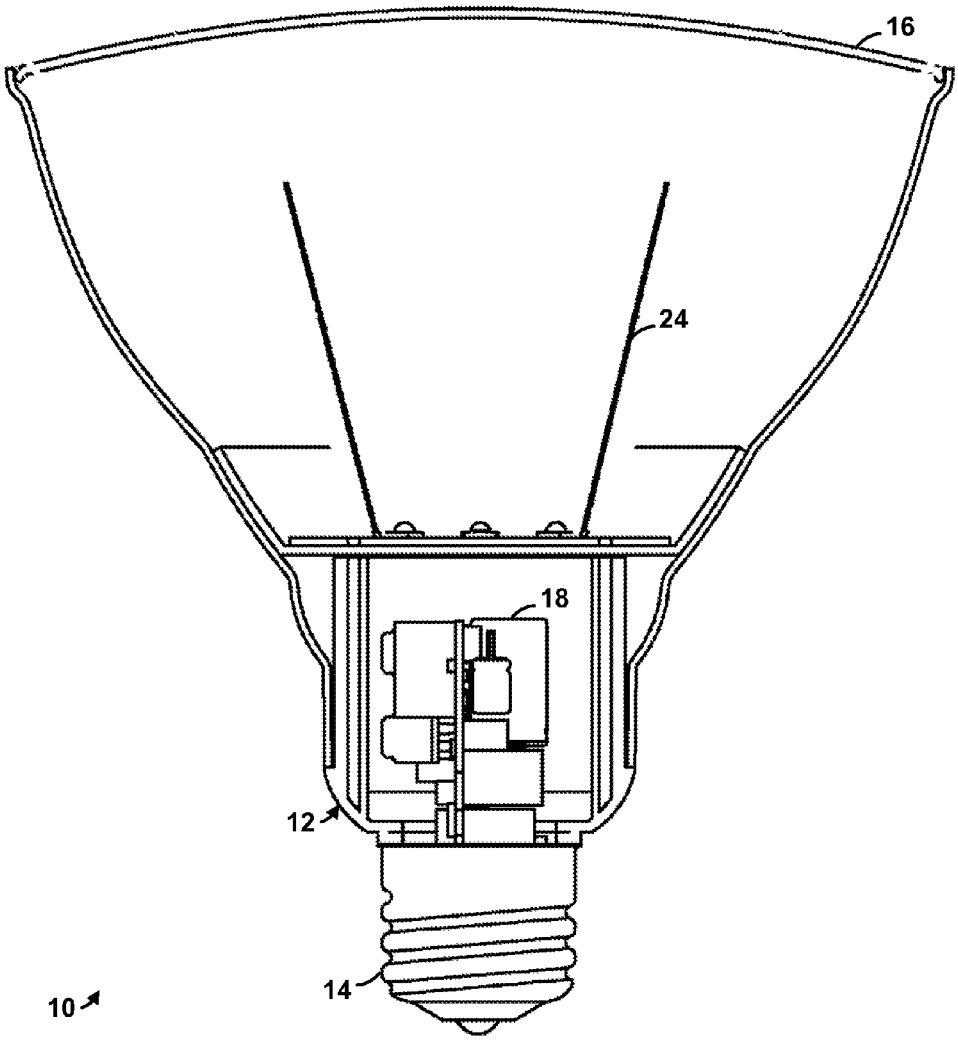
FIG. 3 is a cross-sectional diagram illustrating a third illustrative LED source according to the invention employing a snoot.
Figure 4:
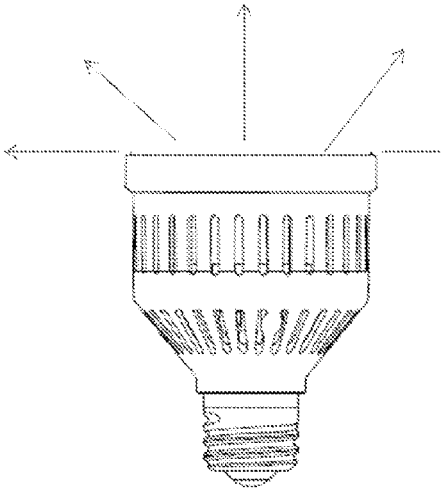
FIG. 4 PRIOR ART
FIG. 4 is an elevation diagram illustrating a prior art LED source.

FIG. 3 is a block diagram of a third illustrative LED source 10 according to the invention. This source includes a generally conical body 12 with a base 14, such as a standard light bulb screw base and a front face 16 that can take a variety of forms, such as a glass cover, a frosted diffuser, or a dimpled lens. The body holds a power supply 18 that receives power from the base and powers one or more LEDs. A snoot 24 is positioned around the LEDS below the front face. The snoot is an at least partially opaque element that defines a surface area that at least partially surrounds and shrouds a light source, restricting the visibility of the LEDs. It is presently contemplated as being cylindrical, but in some instances it might be somewhat conical or have walls that conform to the LEDs or other features of the source.

The snoot can be made of a variety of different materials, but a heat conductive material, such as aluminum, can also allow the snoot to act as a heat sink. The snoot can be reflective or an opaque color, such as black or white. The best color may depend on a variety of factors, including aesthetics in the contemplated application.

As with the reflector and lens element, the height and diameter of the snoot are selected to allow light to shine out of the whole front face (to form a spot or flood), which generally spans essentially the whole front of the source, as well as to shield the LEDs from view from at least some angles (e.g., preferably outside about 45, 55, or even 65 degrees from the axis of illumination). In one embodiment of a PAR-30 lamp, for example, the snoot can end around half an inch below the front face, but it can also end one inch below the front face, or even one-and-a half inches or more below the front face.

Figure 5:
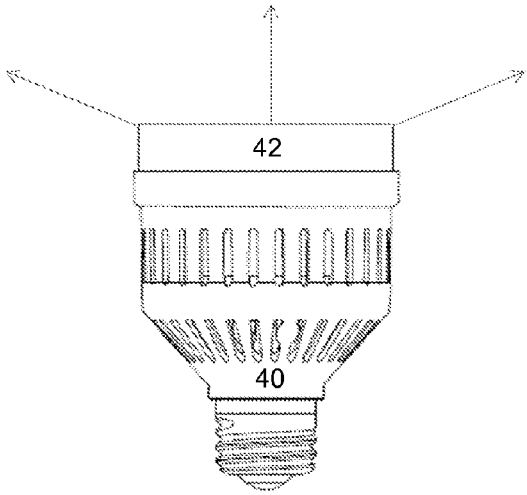
FIG. 5 is an elevation diagram illustrating a fourth illustrative LED source according to the invention employing a first integral snoot.

Referring to FIG. 5, a fourth illustrative LED source 40 according to the invention includes an integral external snoot 42. This snoot can be permanently or removably built into the fixture in a number of different ways. In one embodiment, it is part of an injection molded cover for the source. It can also be a separate part that attached to the source, such as through the use of fasteners, adhesives, or interlocking molded attachment features. In one embodiment, the snoot is sold as a retrofit accessory.

As shown by the arrows in FIG. 5, the external snoot helps to shield glare from the LEDs from view or from at least some angles. This is particularly useful in larger rooms, such those found in public spaces, museums, and retail establishments, because it helps to prevent occupants of these rooms from looking at the bright LEDs in the fixture while they illuminate the room below. This can be accomplished with little loss of light in the case of LED sources, because their LEDs tend to be quite directional, so the snoot does not waste a lot of light.

Figure 6:
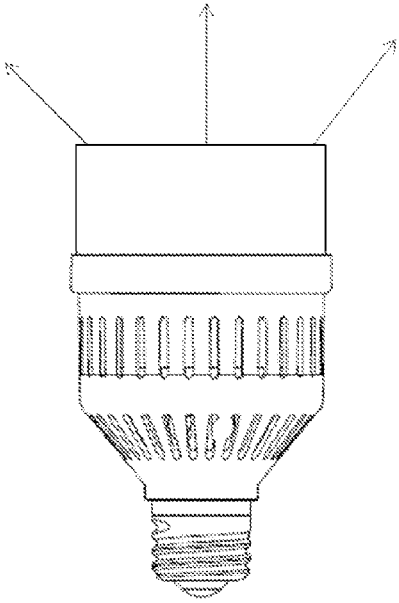
FIG. 6 is an elevation diagram illustrating a fifth illustrative LED source according to the invention employing a second integral snoot that is taller than the first integral snoot.
Figure 7:
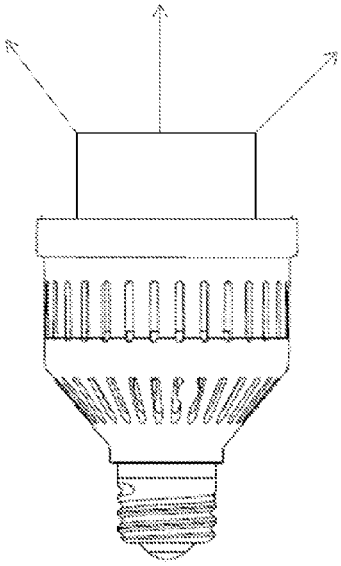
FIG. 7 is an elevation diagram illustrating a sixth illustrative LED source according to the invention employing a second integral snoot that is narrower than the first integral snoot.

As shown in FIG. 6, making the snoot taller helps to shield the LEDs from view from more viewing angles. And as shown in FIG. 7, making the snoot narrower also helps to shield the LEDs from view from more angles. In this embodiment, the snoot covers only a portion of the front of the fixture with the remaining part being an opaque snoot base.

Figure 8A:
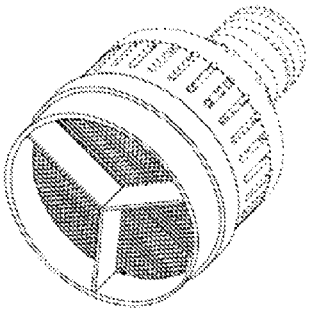
FIG. 8A is a perspective view of a seventh illustrative LED source according to the invention employing an integral snoot equipped with a three-part baffle.
Figure 8B:
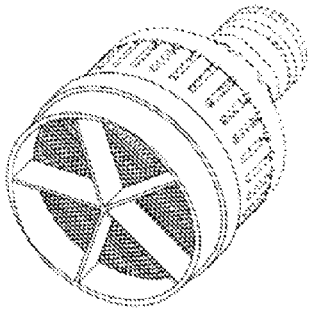
FIG. 8B is a perspective view of a eighth illustrative LED source according to the invention employing an integral snoot equipped with a five-part baffle.
Figure 8C:
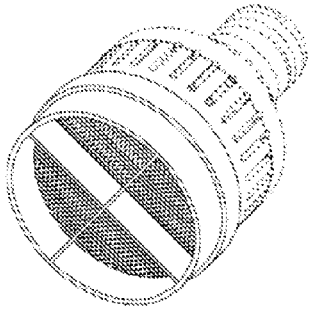
FIG. 8C is a perspective view of a ninth illustrative LED source according to the invention employing an integral snoot equipped with a four-part baffle.

As shown in FIGS. 8A-8C, the fixture can also be equipped with baffles to further restrict the visibility of the LEDs. It is currently considered preferable, but not necessary, to use the baffle walls to separate the LED's. A three-LED source, for example, could use a three-cell baffle, although a three-cell baffle might also be used for a six- or nine-LED source. This separation allows the cells to each act as narrower snoots. The baffles can be arranged according to a variety of different visually pleasing configurations, such as different types of grids or radial arrangements. In one embodiment, the baffles are made in a black color to help reduce glare.

The snoots and baffles described above are particularly well suited to retrofit lamps such as PAR, AR, MR, R and BR style lamps, and their CFL, LED, OLED and other energy-efficient replacements. Making the snoots and baffles part of the source allows them to be optimized to the type of source or application that they cater to. This can help to reduce glare while keeping light loss to a minimum. And by providing removable snoots and baffles, end users can experiment with different configurations in different spaces or different parts of a single space. They can even change lighting characteristics for different situations, such as for different events, exhibits, or product displays. They are well suited to use in a variety of different fixtures, such as freestanding lamps, recessed fixtures, and track lighting fixtures.

The embodiments described above can all be used with active cooling systems or passive heat sinks. In the case of a thermally conductive snoot, the snoot can cooperate with a primary heat sink or an active cooling system to extract some of the heat from the LEDs. The snoot, reflector, and lens elements are generally mounted directly or indirectly to the body of the source, rather than from its front face.

Figure 9:
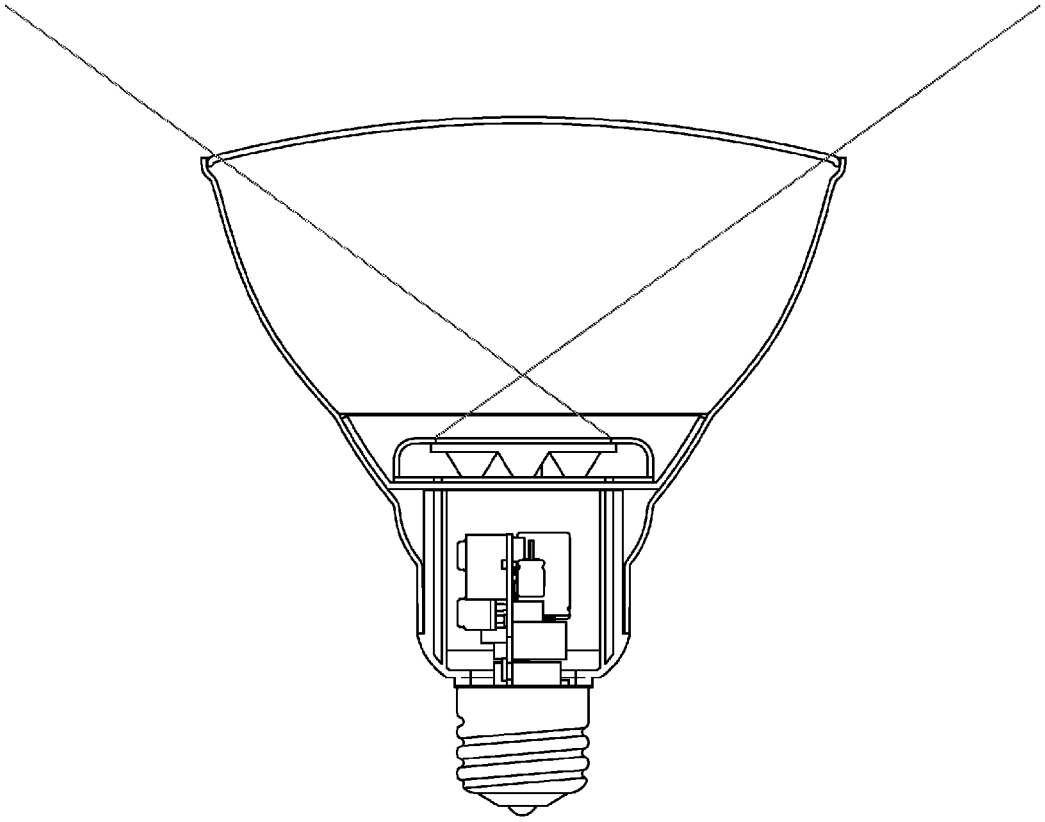
FIG. 9 is a cross-sectional view of a tenth illustrative LED source according to the invention employing a recessed TIR array in an LED PAR 38 configuration.

As shown in FIGS. 9-20, different types of sources can use the different approaches according to the invention. As shown in FIG. 9, for example, a lens element, such as a TIR lens element, which may include a single TIR lens or be part of an array of TIR lenses, is positioned in a recessed position within an LED PAR (Parabolic Aluminum Reflector) 38-type lamp. The TIR lens array shown in this case includes a circular lens plate and downwardly protruding TIR lenses facing each of one or more LEDS placed below it, although other shapes could be developed (see also FIGS. 17-19). As shown by the ray lines on the diagram, the recessed position of the TIR lens and the metal core board that supports it in relation to the outer edge of the housing limits the field of view of the bright point-source glow of the LEDS. This reduced field of view can help prevent people in many places in a room from seeing the LEDS at all. And to people who can see the LEDS, they will tend to resemble a single light source such as a glowing recessed filament, which can be more pleasing and/or more familiar. Different types of face treatments, such as plain, tinted, dimpled or frosted, can modulate this effect.

Figure 10:
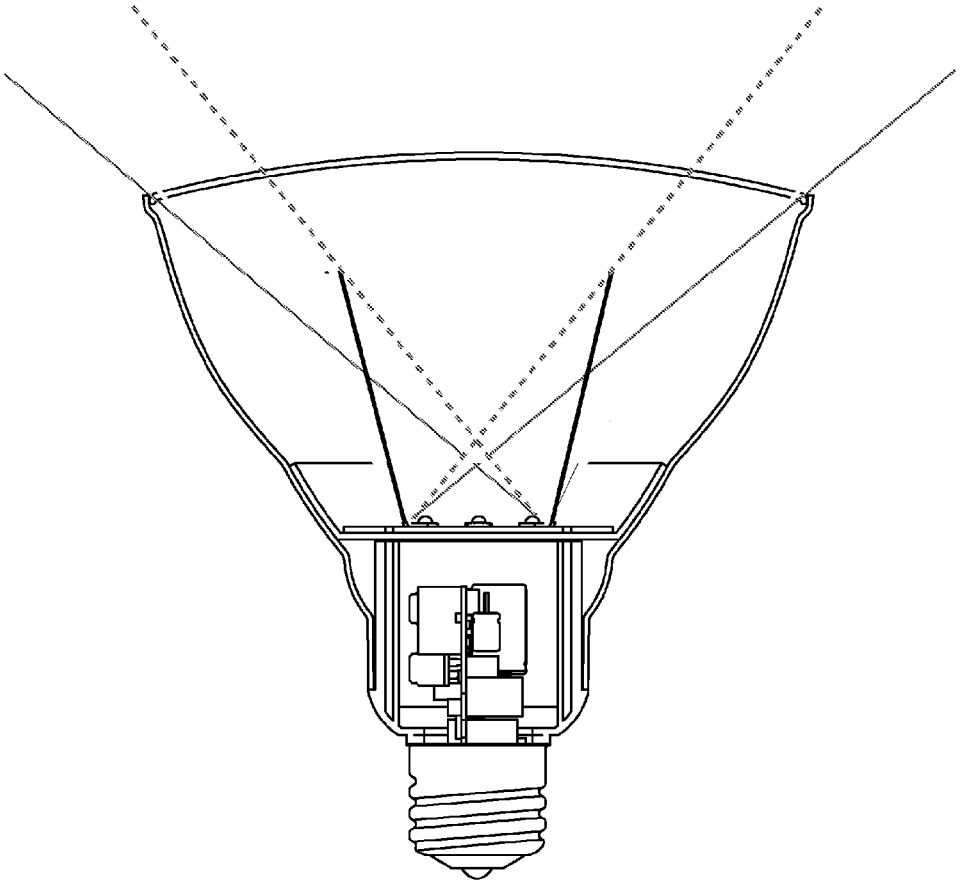
FIG. 10 is a cross-sectional view of an eleventh illustrative LED source according to the invention employing a recessed reflector in an LED PAR 38 configuration.
Figure 11:
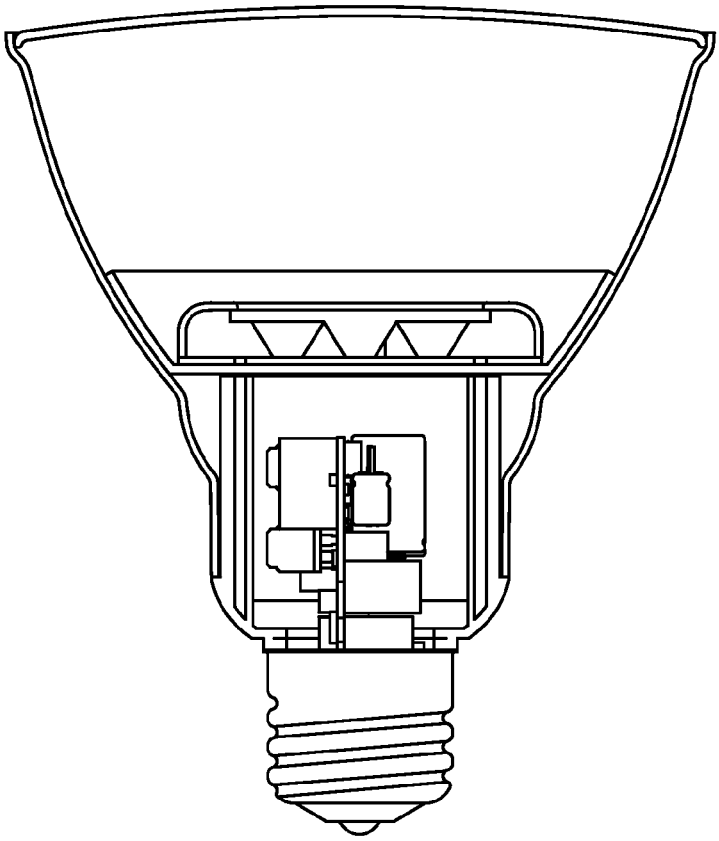
FIG. 11 is a cross-sectional view of a twelfth illustrative LED source according to the invention employing a recessed TIR array in an LED PAR 30 Long Neck (LN) configuration.
Figure 12:
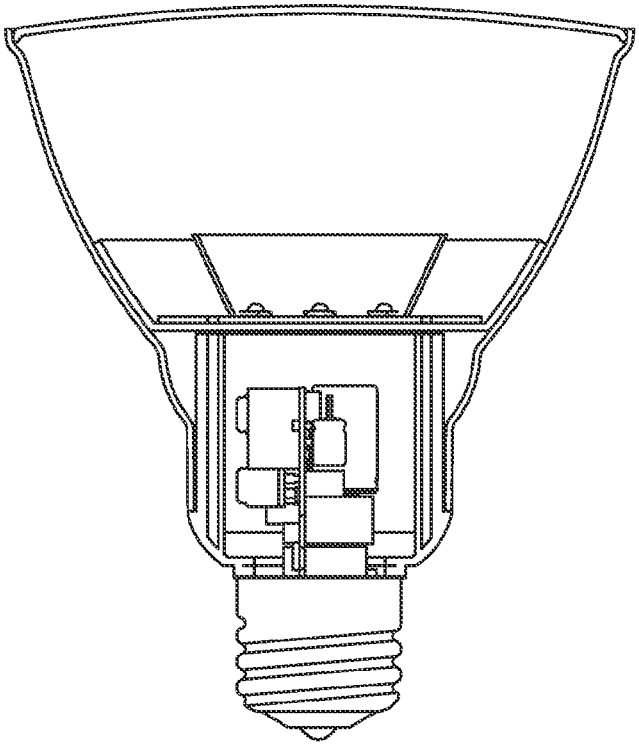
FIG. 12 is a cross-sectional view of a thirteenth illustrative LED source according to the invention employing a recessed reflector in an LED PAR 30 LN configuration.
Figure 13:
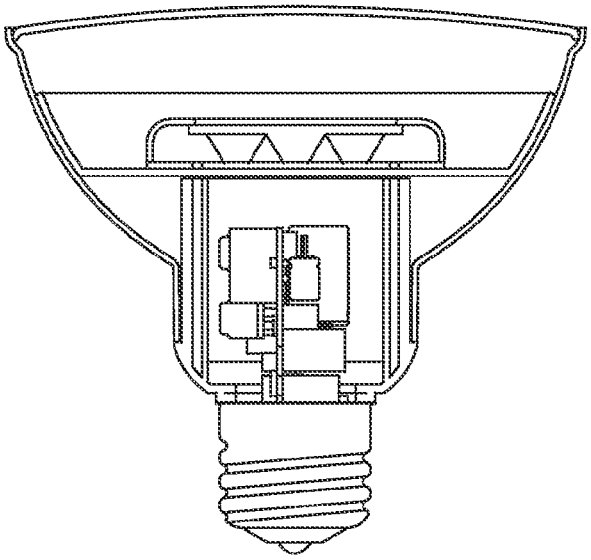
FIG. 13 is a cross-sectional view of a fourteenth illustrative LED source according to the invention employing a recessed TIR array in an LED PAR 30 configuration.
Figure 14:
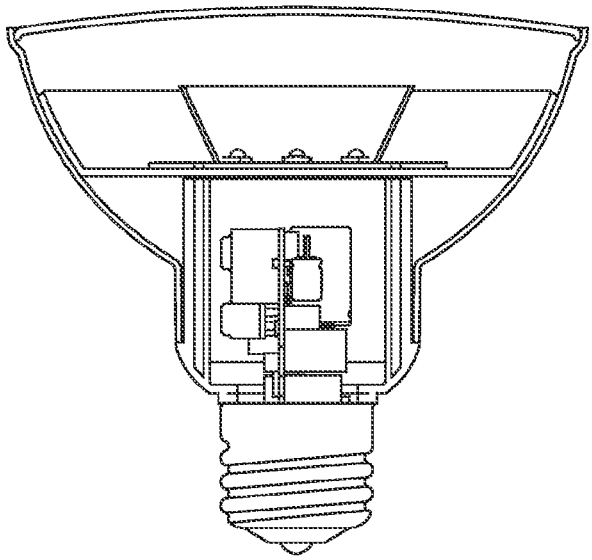
FIG. 14 is a cross-sectional view of a fifteenth illustrative LED source according to the invention employing a recessed reflector in an LED PAR 30 configuration.
Figure 15:
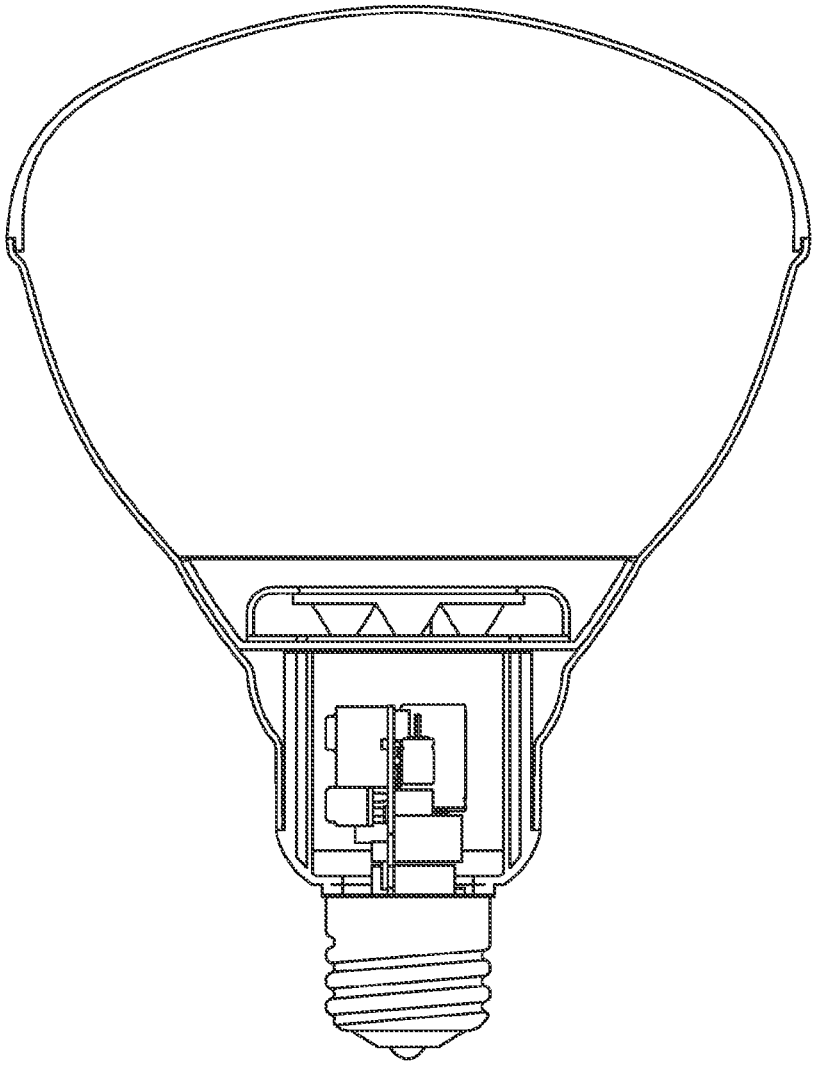
FIG. 15 is a cross-sectional view of a sixteenth illustrative LED source according to the invention employing a recessed TIR array in an LED BR 40 configuration.
Figure 16:
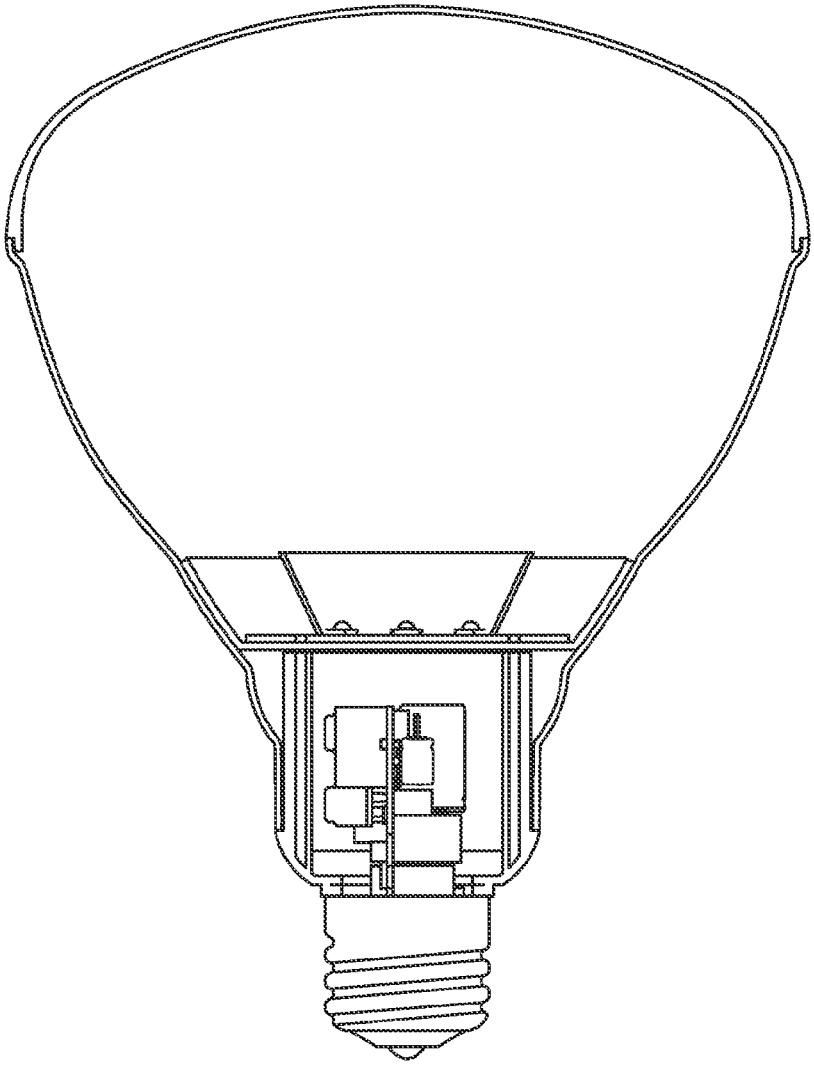
FIG. 16 is a cross-sectional view of a seventeenth illustrative LED source according to the invention employing a recessed reflector in an LED BR 40 configuration.
Figure 17:
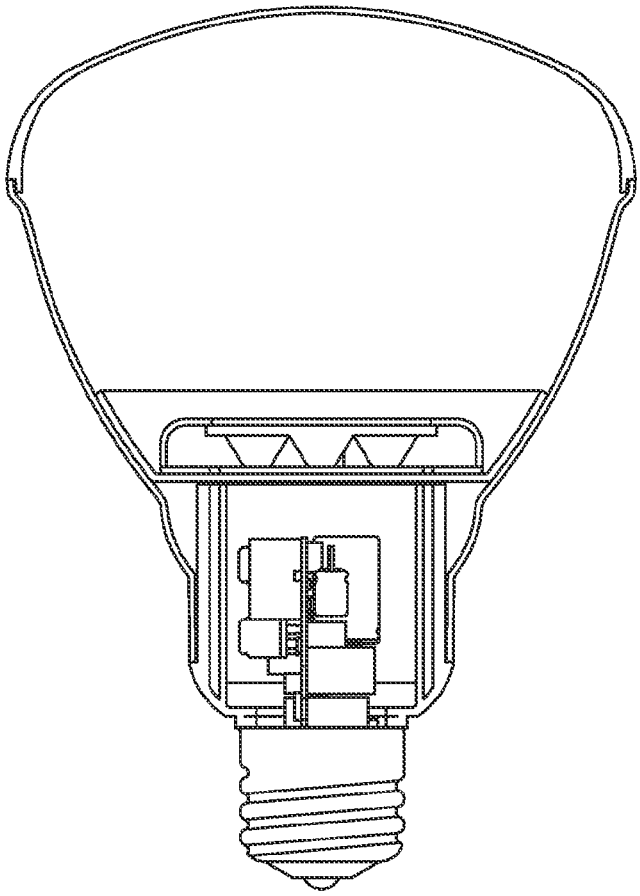
FIG. 17 is a cross-sectional view of an eighteenth illustrative LED source according to the invention employing a recessed TIR array in an LED BR 30 configuration.
Figure 18:
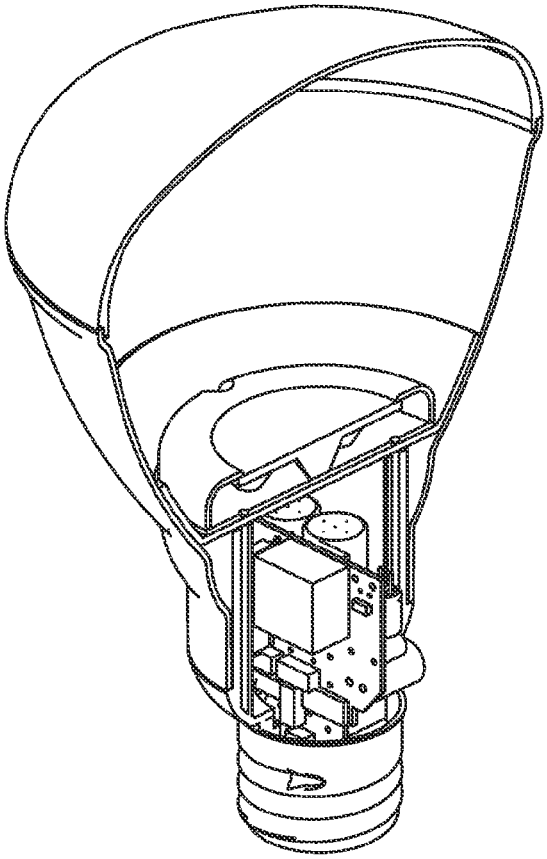
FIG. 18 is a perspective cross-sectional diagram of the embodiment of FIG. 17.
Figure 19:
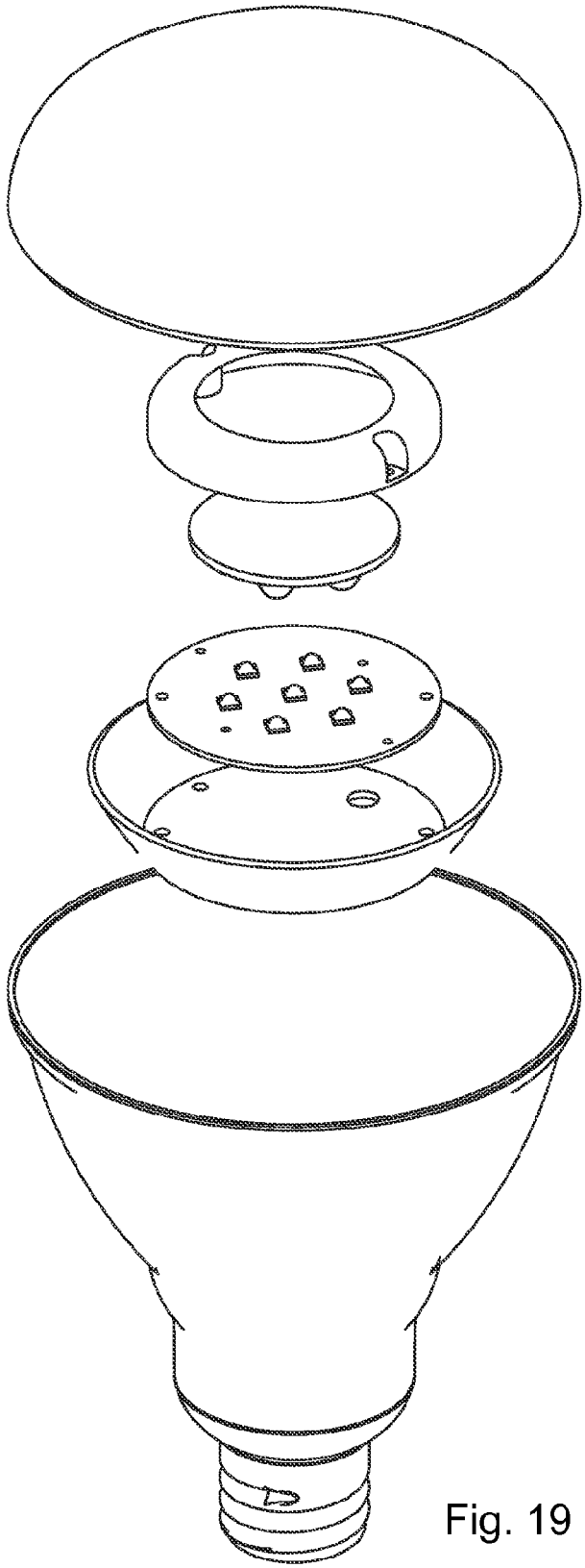
FIG. 19 is an exploded view of the embodiment of FIG. 17.
Figure 20:
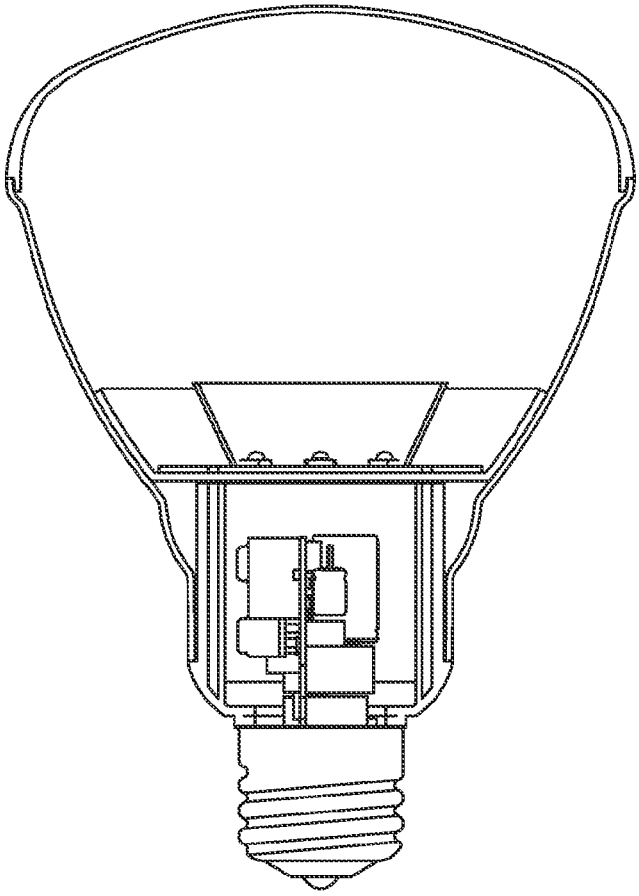
FIG. 20 is a cross-sectional view of a nineteenth illustrative LED source according to the invention employing a recessed reflector in an LED BR 30 configuration.

As shown in FIG. 10, a recessed concave reflector can be positioned in a recessed position within an LED PAR 38-type lamp instead of or in addition to the lens. This figure shows that part of the improved cutoff is due to recessing the optics (solid ray line) and a further part of the improved cutoff is due to the shape of the internal reflector or snoot (dashed ray line).

The shown reflector in this case is an outwardly facing truncated right cone with a circular section with its small end surrounding one or more LEDS, although other shapes can also be developed. As shown by the ray lines on the diagram, the recessed position of the reflector in relation to the outer edge of the housing limits the field of view of the bright point-source glow of the LEDS. This reduced field of view can help prevent people in many places in a room from seeing the LEDS at all. And to people who can see the LEDS, they will tend to resemble a single light source, such as a glowing recessed filament, which can be more pleasing and/or more familiar. Different types of face treatments, such as plain, tinted, dimpled or frosted, can modulate this effect.

Like the TIR of FIG. 9, the mirror of FIG. 10 can focus the light output directly on the front cover for both PAR and BR covers. This increases the efficiency of the lamp light output.

LED based sources can be made to look like and perform like halogen or other types of filament-based sources using the techniques described above. By recessing the LEDS, the glow is placed closer to the base, as it is in halogen lights and other types of filament-based lamps. And by collimating the light using a lens or reflector, a narrower beam angle and higher efficiency can be obtained than would be obtainable with a recessed LED that uses the interior of the body of the light as a reflector.

As shown in FIGS. 9-20, the approaches described above can be applied to many different types of bulbs having different geometrical constraints that may or may correspond to those of existing filament-based models. These include different outer diameters and overall heights as well as different face plate geometries, including domed face plates, such as replacements for Bulged Reflector (BR) lamps.

Figure 21:
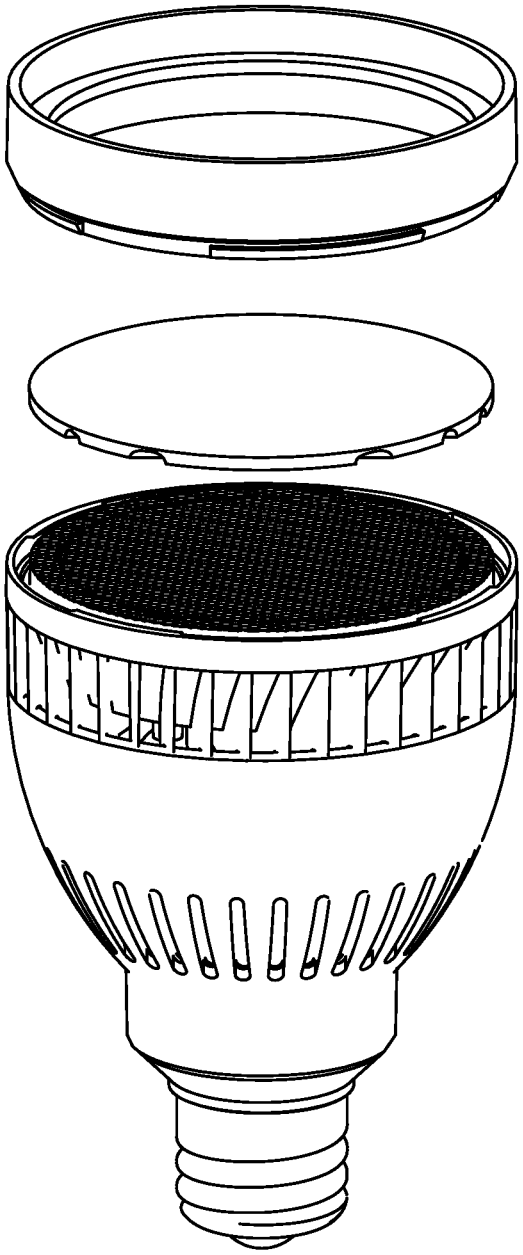
FIG. 21 is an exploded isometric view of an LED source equipped with a removable snoot accessory.
Figure 22:
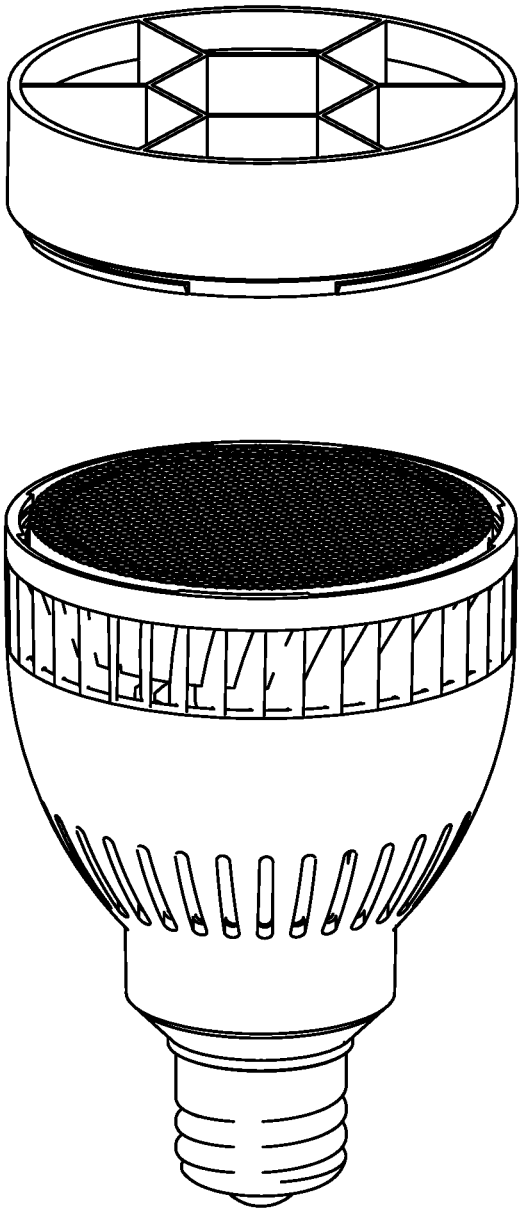
FIG. 22 is an exploded isometric view of an LED source equipped with a removable baffle accessory.
Figure 23:
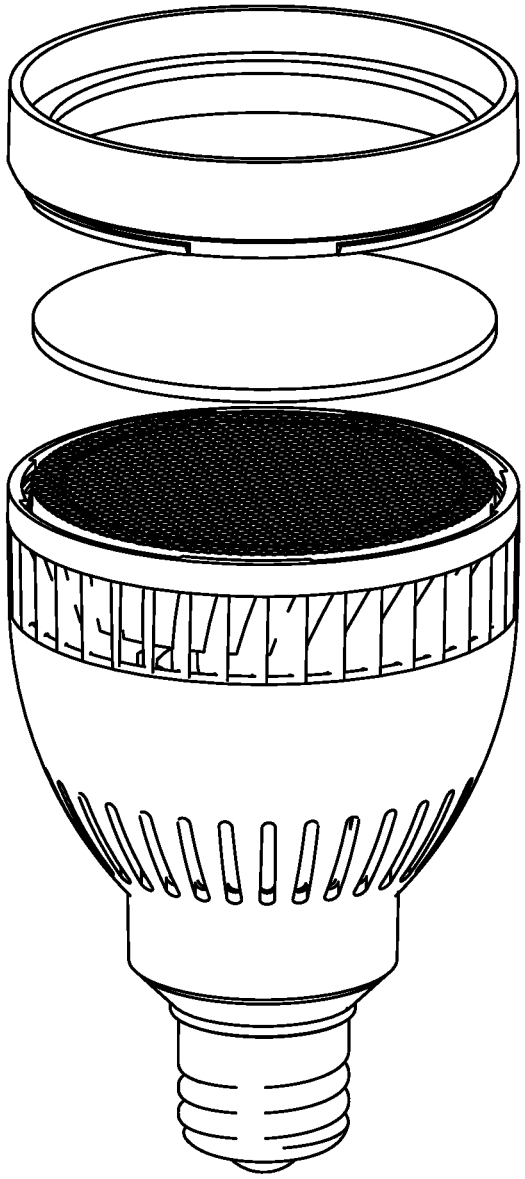
FIG. 23 is an exploded isometric view of an LED source equipped with a removable filter accessory.

Referring to FIGS. 21-23, LED-based sources can also be equipped with removable accessories. These can include a wide variety of types of accessories, including snoots (FIG. 21), baffles, louvers (FIG. 22), gobos, diffusers, magnifying lenses, lens assemblies, or filters (FIG. 23). Filters can include any type of filters, such as color filters, polarizing filters, or band-pass filters.

The accessories can be held in place in a number of different ways. As shown in FIG. 23, a twist-and-lock mechanism can interact directly with accessories (e.g., as shown in FIGS. 21 and 22) and/or allow a removable cover to hold filters or other accessories in place (e.g., for disc-shaped accessories as shown in FIG. 23). This type of cover could also be semi-removable (e.g., hinged from the fixture). Many other types of mechanisms could also be provided, including screw-on mechanisms, fastener-based mechanisms, or clip-on mechanisms (with pressure holding the accessory or holder in place).

The accessory-holding mechanism should be placed outside of the body of the fixture, such that the accessories can be removed without exposing dangerous circuitry in the fixture. Installation and swapping of accessories should preferably require no tools or only a simple tool, such as a screwdriver. This will allow installers or end-users to quickly and safely customize their fixtures and thereby obtain highly tailored lighting effects without the cost and installation time that a custom light fixture might otherwise require.

The present invention has now been described in connection with a number of specific embodiments thereof. However, numerous modifications which are contemplated as falling within the scope of the present invention should now be apparent to those skilled in the art. For example, configurations according to the invention can be applicable to other types of energy-efficient lighting technologies in similar situations. Therefore, it is intended that the scope of the present invention be limited only by the scope of the claims appended hereto. In addition, the order of presentation of the claims should not be construed to limit the scope of any particular term in the claims.

What is claimed is:

1. An illumination source, comprising:

an at least generally conical body extending outward along an axis of illumination for the source, a socket supported with respect to the body, having a pair of connector surfaces for receiving power, and having an axis of insertion at least generally parallel to the axis of illumination, one or more LED illumination elements supported with respect to the body such that at least a portion of their illumination axes are at least generally parallel to the axis of illumination of the source, a power supply having electrical inputs operatively connected to the socket and electrical outputs operatively connected to the LED illumination elements, a front face positioned opposite the socket along the illumination axis, and an optical light-directing element separate from any optical process or packaging surfaces built onto the LEDs, being disposed between the LED illumination elements and the front face, and having medial and distal ends, with the distal end being spaced away from the front face, wherein the optical light-directing element includes a collimating element.

2. The apparatus of claim 1 wherein the optical light-directing element includes a lens element.

3. The apparatus of claim 2 wherein the lens element includes a TIR or Fresnel element.

4. The apparatus of claim 1 wherein the optical light-directing element includes a reflective surface.

5. The apparatus of claim 1 wherein the reflective surface is shaped as a circular truncated section of a right cone.

6. The apparatus of claim 1 wherein the optical light-directing element includes a snoot.

7. The apparatus of claim 1 wherein the front face is clear and wherein the optical light-directing element is placed at a sufficient distance from the front face to significantly reduce an angle of view of the LED illumination elements while allowing light to form a spot beam through the front face.

8. The apparatus of claim 1 wherein the front face is dimpled or frosted and wherein the optical light-directing element is placed at a sufficient distance from the front face to significantly reduce an angle of view of the LED illumination elements while allowing light to form a flood beam through the front face.

9. The apparatus of claim 1 wherein the front face is dimpled or frosted and wherein the optical light-directing element is placed at a sufficient distance from the front face to significantly reduce an angle of view of the LED illumination elements while allowing light to form a directional beam through the front face.

10. The apparatus of claim 1 wherein the optical light-directing element is placed at a sufficient distance from the front face to significantly reduce an angle of view of the LED illumination elements while allowing light to reach substantially all of the front face.

11. The apparatus of claim 1 wherein the angle of view of the LED illumination elements is 65 degrees or less about the axis of illumination.

12. The apparatus of claim 1 wherein the angle of view of the LED illumination elements is 55 degrees or less about the axis of illumination.

13. The apparatus of claim 1 wherein the angle of view of the LED illumination elements is 45 degrees or less about the axis of illumination.

14. The apparatus of claim 1 wherein the optical light-directing element is mounted on the body of the source.

15. The apparatus of claim 1 wherein the source includes a plurality of LEDs.

16. The apparatus of claim 15 wherein the LEDs are supported by a metal core board that support them in relation to an outer edge of the housing that limits the field of view of the LEDS.

17. The apparatus of claim 1 wherein the illumination source is a PAR-type replacement lamp.

18. The apparatus of claim 1 wherein the illumination source is a BR-type replacement lamp.

19. The apparatus of claim 1 wherein the optical light-directing element is separated from the front face by at least 0.5 inches.

20. The apparatus of claim 19 wherein the optical light-directing element is separated from the front face by at least 1 inch.

21. The apparatus of claim 19 wherein the optical light-directing element is separated from the front face by at least 1.5 inches.

22. An illumination source, comprising:

an at least generally conical body extending outward along an axis of illumination of the source, a socket supported with respect to the body, having a pair of connector surfaces for receiving power, and having an axis of insertion at least generally parallel to the axis of illumination, one or more LED illumination elements supported with respect to the body such that at least a portion of their illumination axes are at least generally parallel to the axis of illumination of the source, a power supply having electrical input operatively connected to the socket and electrical outputs operatively connected to the LED illumination elements, a front face positioned opposite the socket along the illumination axis, and an optical light-directing element separate from any optical process or packaging surfaces built onto the LEDs, being disposed between the LED illumination elements and the front face, and having medial and distal ends, with the distal end being spaced away from the front face, wherein the optical light-directing element includes a TIR.

23. An illumination source, comprising:

an at least generally conical body extending outward along an axis of illumination for the source, a socket supported with respect to the body, having a pair of connector surfaces for receiving power, and having an axis of insertion at least generally parallel to the axis of illumination, one or more LED illumination elements supported with respect to the body such that at least a portion of their illumination axes are at least generally parallel to the axis of illumination of the source, a power supply having electrical inputs operatively connected to the socket and electrical outputs operatively connected to the LED illumination elements, a front face positioned opposite the socket along the illumination axis, and an optical light-directing element separate from any optical process or packaging surfaces built onto the LEDs, being disposed between the LED illumination elements and the front face, and having medial and distal ends, with the distal end being spaced away from the front face, wherein the optical light directing element includes at least one opaque surface mounted on the source that is positioned to block light between at least one of the LED illumination elements and positions outside of the circumference of the front face aperture and opposite the base with respect to the front face aperture.

24. An illumination source, comprising:

an at least generally conical body extending outward along an axis of illumination for the source, a socket supported with respect to the body, having a pair of connector surfaces for receiving power, and having an axis of insertion at least generally parallel to the axis of illumination, one or more LED illumination elements supported with respect to the body such that at least a portion of their illumination axes are at least generally parallel to the axis of illumination of the source, a power supply having electrical inputs operatively connected to the socket and electrical outputs operatively connected to the LED illumination elements, a front face positioned opposite the socket along the illumination axis, and an optical light-directing element separate from any optical process or packaging surfaces built onto the LEDs, being disposed between the LED illumination elements and the front face, and having medial and distal ends, with the distal end being spaced away from the front face, wherein the optical light-directing element is separated from the front face by at least 0.5 inches.

25. The apparatus of claim 24 wherein the optical light-directing element is separated from the front face by at least 1 inch.

26. The apparatus of claim 25 wherein the optical light-directing element is separated from the front face by at least 1.5 inches.

27. An illumination method, comprising:

receiving power at a socket, converting the received power and sending it to one or more LED elements, redirecting light from the LED powered elements by a lens element, shining the redirected light through an optically neutral area, and shining the redirected light through a front face after it has shined through for optically neutral area.

28. The method of claim 27 wherein the step of redirecting shields the LED elements from view from at least a subset of an area illuminated through the front face.

29. An illumination source, comprising:

means for receiving power, means converting received power and sending it to one or more LED elements, means for colimating at least some of the light from the LED powered elements, optically neutral means for passing the redirected light, and front face means for passing the redirected light after it has passed through the optically neutral area.

* * * * *